US006209203B1

(12) United States Patent
Murthy et al.

(10) Patent No.: US 6,209,203 B1
(45) Date of Patent: Apr. 3, 2001

(54) METHOD FOR MAKING NOZZLE ARRAY FOR PRINTHEAD

(75) Inventors: Ashok Murthy; James Harold Powers; Sudarsan Srinivasan, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/004,396

(22) Filed: Jan. 8, 1998

(51) Int. Cl.[7] ..... B41J 2/135
(52) U.S. Cl. ..... 29/890.1; 347/47
(58) Field of Search ..... 29/890.1; 216/27, 216/65, 56; 347/47

(56) References Cited

U.S. PATENT DOCUMENTS

| | | | | |
|---|---|---|---|---|
| 4,007,464 | * | 2/1977 | Bassous et al. . | |
| 4,963,882 | | 10/1990 | Hickman . | |
| 5,185,055 | * | 2/1993 | Temple et al. | 216/27 |
| 5,189,437 | * | 2/1993 | Michaelis et al. . | |
| 5,208,604 | * | 5/1993 | Watanabe et al. . | |
| 5,278,584 | * | 1/1994 | Keefe et al. . | |
| 5,291,226 | * | 3/1994 | Schantz et al. . | |
| 5,300,959 | * | 4/1994 | McClelland et al. | 347/47 |
| 5,305,015 | * | 4/1994 | Schantz et al. . | |
| 5,408,738 | * | 4/1995 | Schantz et al. . | |
| 5,548,894 | * | 8/1996 | Muto . | |
| 5,640,183 | | 6/1997 | Hackleman . | |
| 5,653,901 | * | 8/1997 | Yoshimura . | |
| 5,672,210 | * | 9/1997 | Moto et al. . | |
| 5,685,074 | * | 11/1997 | Pan et al. | 29/890.1 |
| 5,738,799 | * | 4/1998 | Hawkins et al. | 216/27 |
| 5,766,497 | * | 6/1998 | Mitwalsky et al. | 216/56 |
| 5,796,416 | | 8/1998 | Silverbrook . | |
| 5,809,646 | * | 9/1998 | Reinecke et al. | 29/890.1 |
| 5,815,173 | | 9/1998 | Silverbrook . | |

FOREIGN PATENT DOCUMENTS

| | | |
|---|---|---|
| 0 498 291 B1 | 4/1996 | (EP) . |
| WO 96/32263 | 4/1995 | (WO) . |

* cited by examiner

*Primary Examiner*—Irene Cuda
*Assistant Examiner*—Trinh T. Nguyen
(74) *Attorney, Agent, or Firm*—Michael T. Sanderson

(57) ABSTRACT

A method for making a nozzle plate for an inkjet printer by laser ablating a nozzle plate material. The method includes the steps of a) determining a plurality of desired nozzle hole locations, b) ablating the area of the nozzle plate material surrounding the desired locations of the holes to a predetermined depth to provide a plurality of flow paths c) ablating a nozzle through the full thickness of the nozzle plate material at each desired nozzle hole location, wherein unablated material surrounds each nozzle hole to provide a chamber, and d) ablating a throat region through a portion of the unablated material surrounding each nozzle hole so that each chamber is in flow communication with at least one flow path outside of the chamber.

12 Claims, 9 Drawing Sheets

METHOD FOR MAKING NOZZLE ARRAY FOR PRINTHEAD

FIELD OF THE INVENTION

This invention relates generally to printheads for thermal inkjet print cartridges. More particularly, this invention relates to the manufacture of nozzle plates for printheads.

BACKGROUND OF THE INVENTION

Thermal inkjet printers utilize print cartridges having printheads for directing ink droplets onto a medium, such as paper, in patterns corresponding to the indicia to be printed on the paper. In general, ink is directed from a reservoir via flow paths to bubble chambers and associated orifices or nozzles for release onto the paper. Heaters are provided adjacent the nozzles for heating ink supplied to the nozzles to vaporize a component in the ink in order to propel droplets of ink through the nozzle holes to provide a dot of ink on the paper. During a printing operation the print head is moved relative to the paper and ink droplets are released in patterns corresponding to the indicia to be printed by electronically controlling the heaters to selectively operate only the heaters corresponding to nozzles through which ink is to be ejected for a given position of the printhead relative to the paper.

Printheads typically include a nozzle plate attached, as by adhesive, to a silicon chip containing the heating elements. The flowpaths, bubble chambers and nozzles are typically provided by laser ablating the nozzle plate material to provide such structure. As will be appreciated, the precision and uniformity of such features significantly affect the quality of printing. Thus, for example, if the walls which surround the nozzles and define the bubble chambers do not smoothly interface the silicon chip, leakage can result and adversely affect print quality. Conventional methods for manufacturing nozzle plates often fail to provide the desired precision and uniformity of the flow features thus adversely affecting the yield of usable nozzle plates and/or the performance of the printer.

Accordingly it is an object of the present invention to provide an improved method for the manufacture of inkjet printheads.

Another object of the present invention is to provide a method of the character described which enables the production of printheads having greater reliability and performance characteristics as compared to printheads provided using conventional techniques.

A further object of the present invention is to provide a method for manufacturing a printhead having an improved nozzle and heater array.

An additional object of the present invention is to provide a method of the character described which avoids many of the disadvantages of conventional methods.

SUMMARY OF THE INVENTION

Having regard to the foregoing and other objects, the present invention is directed to a method for making a nozzle plate for an inkjet printer by laser ablating a nozzle plate material. The method includes the steps of a) selecting a plurality of desired nozzle hole locations, b) ablating a first portion of the nozzle plate material in an area of the nozzle plate material adjacent each nozzle hole location to a predetermined depth to provide a plurality of flow paths c) ablating nozzle holes through the full thickness of the nozzle plate material at each desired nozzle hole location, wherein unablated material remains adjacent each nozzle hole to provide an ink chamber, and d) ablating a throat region through a second portion of the nozzle plate material adjacent each nozzle hole so that each ink chamber is in flow communication with at least one flow path outside of the chamber.

The method of the invention enables nozzle plates of improved quality and precision as compared to those manufactured using conventional techniques. For example, the method enables the manufacture of nozzle plates having smoother and more uniform surfaces as well as finer flow features. In particular, the invention enables the formation of bubble chamber walls having a thickness of less than about 10 microns and having substantially uniform wall features which provide an improved interface between the nozzle plate and the underlying silicon chip so that problems associated with ink leaking between the upper wall edges of the ink chambers and the silicon chip is substantially avoided.

According to another aspect of the invention, the invention provides a method for making a nozzle plate for an inkjet printer by laser ablating a nozzle plate material. The method includes the steps of laser ablating the nozzle plate material to provide a first nozzle hole array having a plurality of nozzle holes, each of which is positioned to correspond to a desired print location, with the print location of each of the nozzle holes of the first nozzle array being different from one another; and laser ablating the nozzle plate material to provide a second nozzle hole array having a plurality of nozzle holes, each nozzle hole of the second nozzle hole array being positioned to correspond to a desired print location, with the print location of each of the nozzle holes of the second array corresponding to one of the print locations of the first nozzle hole array such that the first and second nozzle hole arrays each have a nozzle hole corresponding to each desired print location so that at least two nozzle holes are provided for each print location.

Preferred nozzle plates manufactured in accordance with the invention provide a redundancy feature in that the resulting printhead includes at least two nozzle holes (and associated heaters) for each print location. During a printing process, the printer controller alternates between the at least two nozzles such that the effect of an improperly operating heater and/or nozzle is significantly reduced.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1:
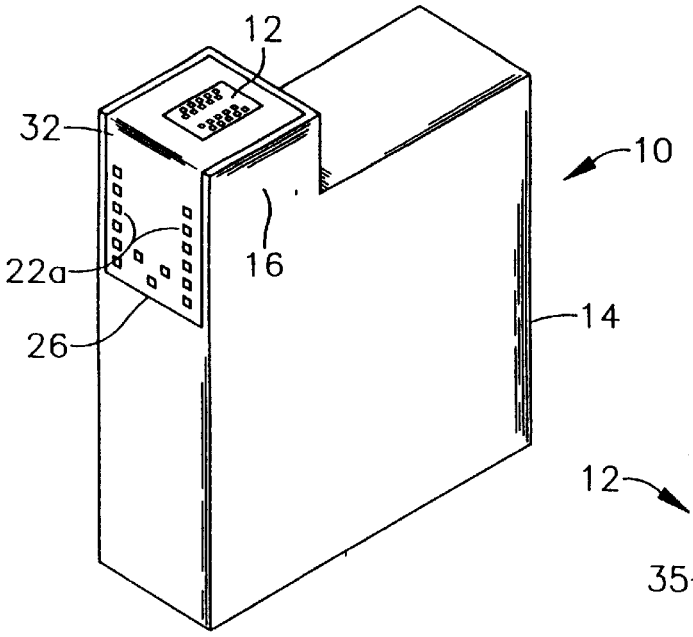
FIG. 1 is a perspective view of an inkjet cartridge having a printhead in accordance with a preferred embodiment of the invention.

Referring now to the figures, there is depicted in FIG. 1 a print cartridge 10 in accordance with a preferred embodiment of the invention for use with inkjet printers. The cartridge 10 includes a printhead assembly 12 located above an ink reservoir 14 provided by a generally hollow plastic body containing ink or a foam insert saturated with ink.

The printhead assembly 12 is preferably located on an upper portion of a nose piece 16 of the body of cartridge 10 for transferring ink from the ink reservoir 14 onto a medium to be printed, such as paper, in patterns representing the desired indicia. As used herein, the term "ink" will be understood to refer generally to inks, dyes and the like commonly used for thermal inkjet printers.

Figure 2:
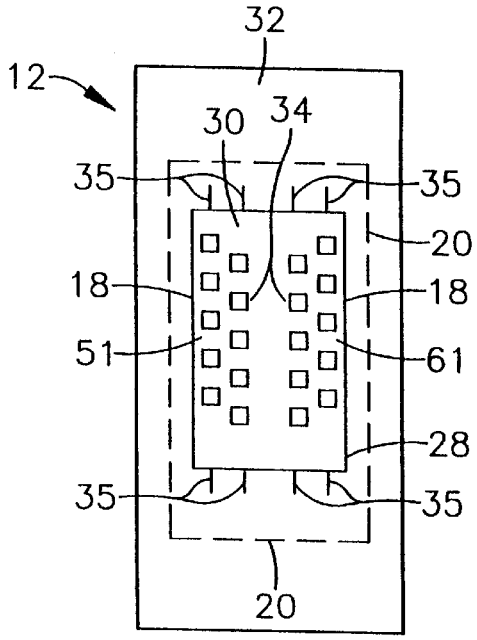
FIG. 2 is an enlarged top plan view of a portion of a printhead for a printer according to the invention.
Figure 3:
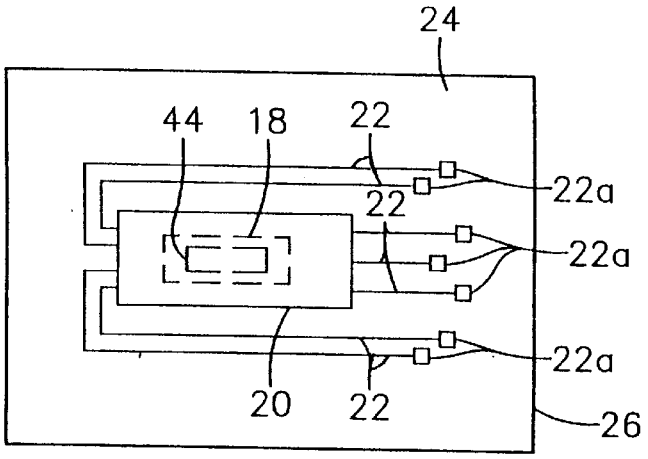
FIG. 3 is a bottom plan view of a printhead for a printer according to the invention.

With additional reference to FIGS. 2 and 3, the printhead 12 preferably includes a nozzle member 18 attached to a silicon member 20, with the silicon member in electrical communication with a plurality of electrically conductive traces 22 provided on a back surface 24 of a polymer tape strip 26. A preferred adhesive attaching the nozzle plate to the substrate is a B-stageable thermal cure resin including, but not limited to phenolic resins, resorcinol resins, urea resins, epoxy resins, ethylene-urea resins, furane resins, polyurethane resins and silicon resins. The thickness of the adhesive layer range from about 1 to about 25 microns.

The nozzle member 18 is preferably provided by a polyimide polymer tape composite material with an adhesive layer on one side thereof, the composite material having a total thickness ranging from about 15 to about 200 microns, with such composite materials being generally referred to as "Coverlay" in the industry. Suitable composite materials include materials available from DuPont Corporation of Wilmington, Del. under the trade name PYRALUX and from Rogers Corporation of Chandler, Ariz. under the trade name R-FLEX. However, it will be understood that the provision of nozzle holes and heaters in accordance with the present invention is applicable to nozzle plates of virtually any material including also, but not limited to, metal and metal coated plastic.

Each trace 22 preferably terminates at a contact pad 22*a* and each pad 22*a* extends through to an outer surface 32 of the tape 26 for contacting electrical contacts of the inkjet printer to conduct output signals from the printer to heater elements on silicon member 20. The traces may be provided on the tape as by plating processes and/or photo lithographic etching. The tape/electrical trace structure is referred to generally in the art as a "TAB" strip, which is an acronym for Tape Automated Bonding.

The silicon member 20 is hidden from view in the assembled printhead and is attached to nozzle member 18 in a removed area or cutout portion 28 of the tape 26 such that an outwardly facing surface 30 of the nozzle member is generally flush with and parallel to a front surface 32 of the tape 26 for directing ink onto the medium to be printed via a plurality of nozzle holes 34 in flow communication with the ink reservoir 14. The nozzle holes 34 are preferably substantially circular, elliptical, square or rectangular in cross section along an axis parallel to a plane defined by the nozzle member 18.

Silicon bonds or wires 35 electrically connect the traces 22 to the silicon member 20 to enable electrical signals to be conducted from the printer to the silicon member for selective activation of the heaters during a printing operation. Thus, the heaters 36 (FIG. 4) are electrically coupled to the conductive traces 22 via the silicon bonds 35 and electrically coupled between the TAB bonds 35 and the contact pads 22*a* for energization thereof in accordance with commands from the printer. In this regard, a demultiplexer 44 (FIG. 3) is preferably provided on the silicon member 20 for demultiplexing incoming electrical signals and distributing them to the heaters 36.

Figure 4:
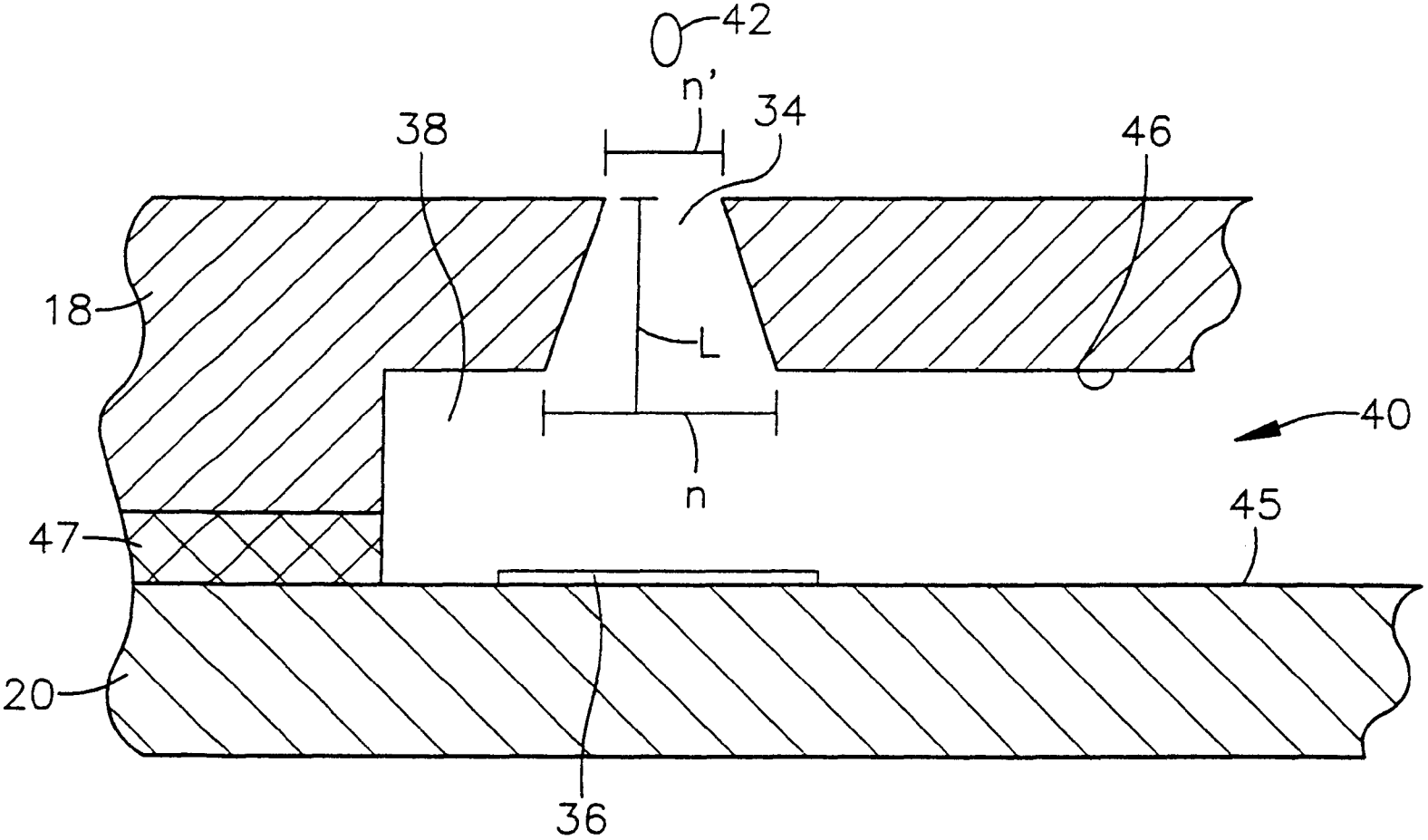
FIG. 4 is an enlarged partial cross-sectional view of a nozzle plate and heater assembly for a printhead according to the invention.

With reference to FIG. 4, the silicon member 20 is preferably a generally rectangular portion of a silicon substrate of the type commonly used in the manufacture of print heads. A plurality of thin film resistors or heaters 36 are provided on the silicon member, with one such heater being located adjacent each one of the nozzle holes 34 for vaporizing ink for ejection through the nozzle holes 34. In this regard, each heater 36 is preferably located adjacent a bubble chamber 38 associated with each nozzle hole 34 for heating ink conducted into the chamber via a channel 40 from the ink reservoir 14 to vaporize ink in the chamber and eject it out the nozzle hole 34 for condensing into an ink droplet 42 which strikes the medium to be printed at a desired location thereon.

The silicon member 20 has a size typically ranging from about 2 to about 3 millimeters wide with a length ranging from about 6 to about 12 millimeters long and from about 0.3 to about 1.2 millimeters in thickness and most preferably from about 0.5 to about 0.8 millimeters thick. The printhead 12 may contain one, two, three or more silicon members 20 and nozzle members 18, however, for purposes of simplifying the description, the printhead assembly will be described as containing only one silicon member 20 and associated nozzle member 18.

The ink travels generally by gravity and capillary action from the reservoir 14 around the perimeter of the silicon member 20 or through a central via in the silicon member into the channels 40 for passage into the bubble chambers. The relatively small size of the nozzle holes 34 maintains the ink within the chambers 38 until activation of the associated heaters which vaporizes a volatile component in the ink and voids the chamber after which it refills again by capillary action.

As will be noted, the lower wall of the bubble chamber 38 and the channel 40 associated with each nozzle hole 34 is provided by the adjacent substantially planar surface 45 of the silicon member. The topographic features of the chambers 38 and the channel 40 are provided by the shape and configuration of a lower surface 46 of the nozzle member 18 which is attached by means of an adhesive layer 47 to the surface 45 of the silicon member 20. The flow features of the nozzle member 18, such as the nozzle holes 34, bubble chambers 38 and channels 40 are preferably formed in the composite material of the nozzle member 18 by laser ablating the material to provide configuration as shown in FIGS. 5 and 6.

Figure 5A:
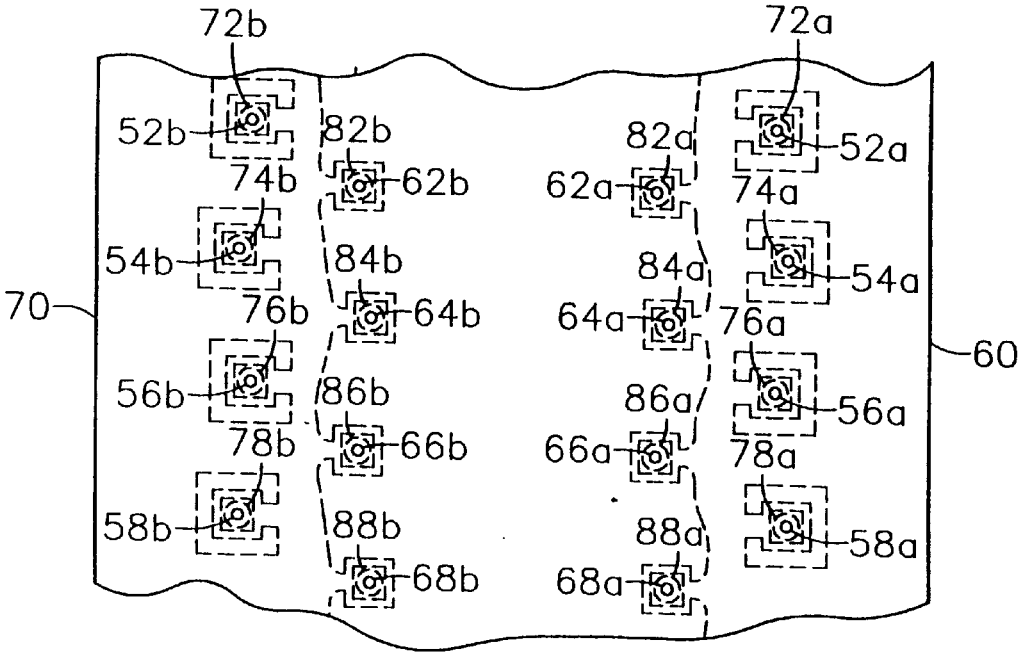
FIG. 5*a* is an enlarged partial top view of a nozzle plate according to the invention.
Figure 5:
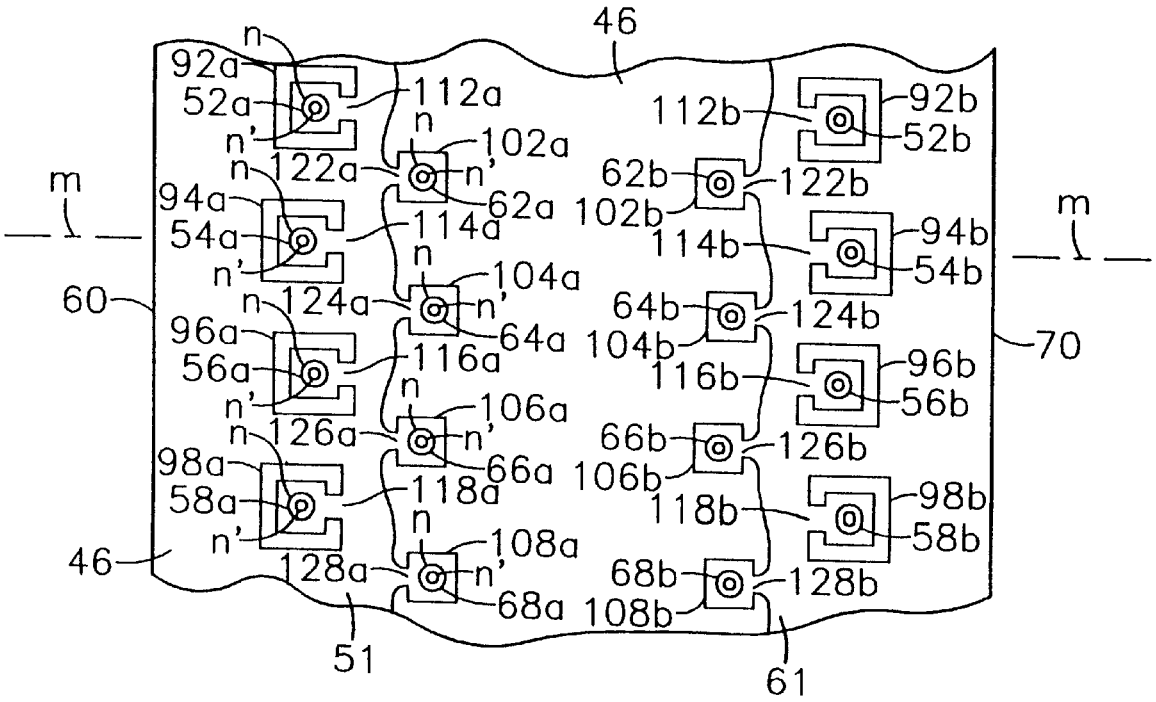
FIG. 5 is an enlarged partial bottom plan view of a nozzle plate for a printhead according to the invention.
Figure 6:
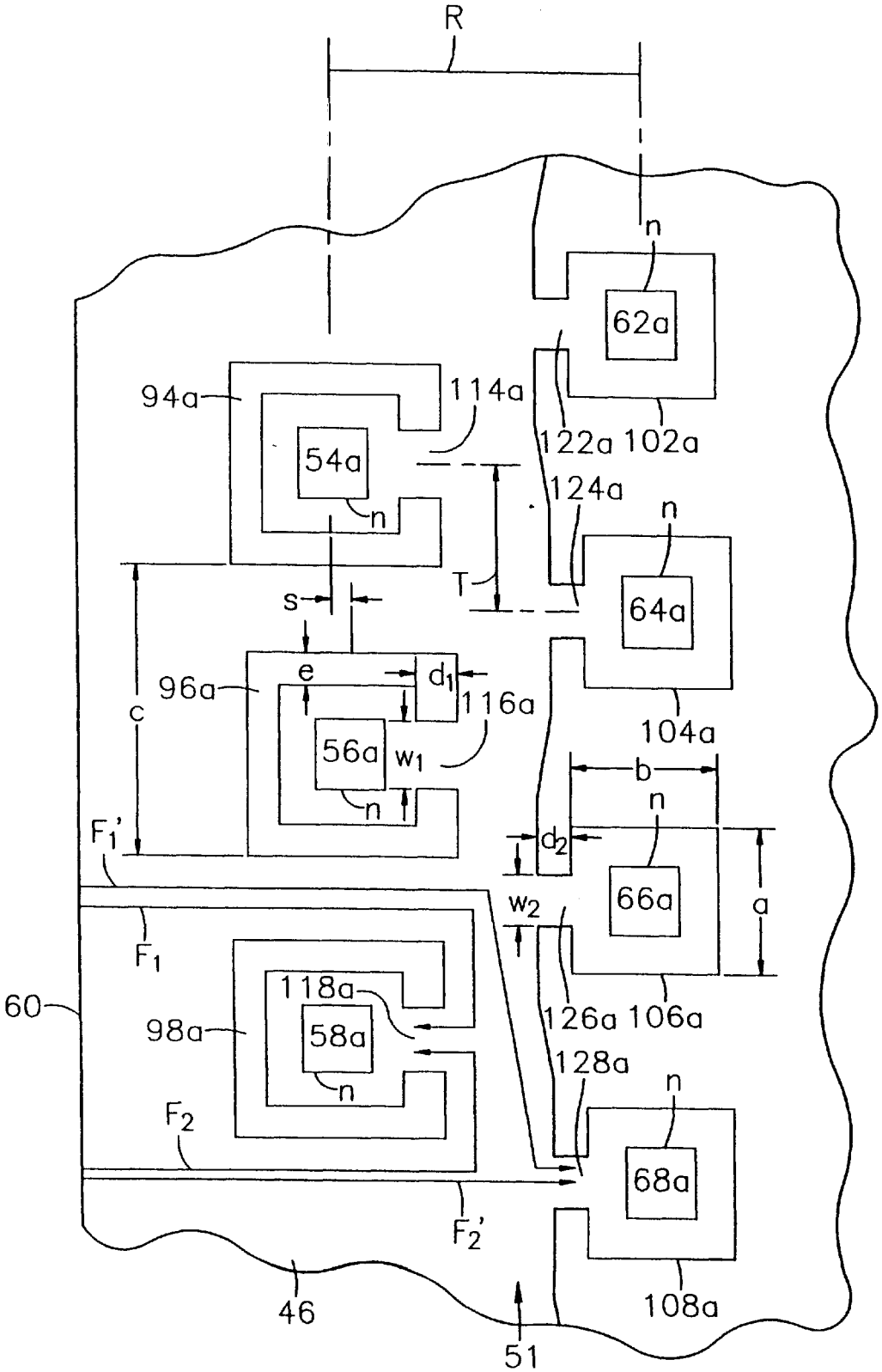
FIG. 6 is an enlarged view of a portion of the nozzle plate of FIG. 5.

Accordingly, and with reference to FIGS. 5–6, the lower surface 46 of the nozzle member 18 is preferably configured to provide a pair of nozzle holes and associated heaters for each print location. The term "print location" will be understood to refer to the location of a nozzle for directing a specific ink bubble or droplet onto the paper to be printed. Conventionally, one nozzle is provided for each print location with sufficient nozzles provided to enable printing of pixel or ink-dot patterns corresponding to virtually any character or image. Thus, failure of a single nozzle can detrimentally affect the printed image.

In accordance with the present invention, there is provided a print head having a pair of nozzles at each print location with the heaters 36 for each nozzle being alternatively activated such that the effect of the failure of a single nozzle of the nozzle pair on the quality of the printed image may be reduced. As will be appreciated, this provides a redundancy feature heretofore unavailable which reduces the effect of a failed nozzle or heater. As used herein, the terminology "alternatively activated" refers to the sequencing associated with ejecting ink from the nozzles of a pair by which the nozzles are activated one after the other or one nozzle may be activated two or more times concurrently before the other nozzle is activated.

The individual nozzle holes 34 and heaters 36 are independently numbered as shown in drawing FIGS. 5–6, with the nozzles and heaters of each print location bearing the same integer but with the suffix "a" or "b" to represent their plurality. Accordingly, in a preferred embodiment, the nozzle member 18 is formed to provide a nozzle array 51 positioned adjacent side edge 60 of the silicon member 20 and a nozzle array 61 positioned adjacent side edge 70 of the silicon member 20 (FIG. 2).

Nozzle array 51 includes two rows of nozzles, one row comprising nozzles 52*a*, 54*a*, 56*a*, 58*a*, and the other row comprising nozzles 62*a*, 64*a*, 66*a*, and 68*a*. Nozzle array 61 includes two rows of nozzles, one row comprising nozzles 52*b*, 54*b*, 56*b*, 58*b*, and the other row comprising nozzles 62*b*, 64*b*, 66*b*, and 68*b*. As will be seen, an imaginary line may be drawn to bisect between members of a nozzle pair, e.g., bisecting line M drawn between the center of nozzles 54*a* and 54*b*, which nozzles represent the same print location.

With reference now to FIG. 6, it will be noted that the nozzles of the array 51 are arranged in two rows, one row having nozzles 54*a*, 56*a* and 58*a*, and the other row having nozzles 62*a*, 64*a*, 66*a* and 68*a*. Array 61 is similarly configured as to the "b" suffix of the corresponding nozzles in array 51. As noted previously, the "a" and "b" suffixed nozzles of a common-integered nozzles, e.g., nozzles 52*a* and 52*b*, correspond to the same print location and provide a redundancy feature which reduces the effect of the failure of a nozzle or heater at a print location. This is accomplished in a preferred embodiment by alternating between the pair of nozzles (a and b) during a printing sequence.

Heater 72*a* is positioned below nozzle 52*a* and heater 72*b* is positioned below nozzle 52*b* as shown in FIG. 5*a*. Likewise, heaters 74*a*–74*b*, 76*a*–76*b*, 78*a*–78*b* are positioned below nozzle pairs 54*a*–54*b*, 56*a*–56*b*, 58*a*–58*b*, respectively; and heaters 82*a*–82*b*, 84*a*–84*b*, 86*a*–86*b*, 88*a*–88*b* are positioned below nozzle pairs 62*a*–62*b*, 64*a*–64*b*, 66*a*–66*b*, 68*a*–68*b*, respectively. As will be appreciated, the printhead preferably includes more than the eight described nozzle/heater pairs and, in a preferred embodiment includes from about 20 to about 20,000 nozzle/heater pairs, preferably from about 200 to about 2,000, with the members of each pair provided in separate arrays. In this regard, it is contemplated that at least two arrays be provided. Further arrays may be included to provide even further redundancy, with each array having a nozzle/heater pair for each print location.

With reference again to FIG. 4, in which it will be understood that nozzle hole 34 is representative of each nozzle of the arrays 51 and 61, i.e., nozzles 52–58 and 62–68, the nozzle hole 34 preferably has a length L of from about 10 to about 100 $\mu$m and has tapered walls moving from bubble chamber 38 to the top surface of the nozzle member 18, the entrance opening n being preferably from about 5 to about 80 $\mu$m in width and the exit opening n' being from about 5 to about 80 $\mu$m in width. Each bubble chamber 38 and channel 40, one each of which feeds a nozzle, is sized to provide a desired amount of ink to each nozzle, which volume is preferably from about 1 pl to about 200 pl. In this regard, each bubble chamber 38 preferably has a volume of from about 1 pl to about 400 pl and each channel 40 preferably has a flow area of from about 20 $\mu m^2$ to about 1000 $\mu m^2$.

As noted previously, the flow features of the nozzle member 18, such as the nozzle holes 34, bubble chambers 38 and channels 40 are preferably formed as by laser ablating a polymeric material to provide configuration as shown in FIGS. 5–6. In this regard, the nozzle member 18 is preferably configured to provide a barrier wall for each nozzle location which is shaped to provide a suitable bubble chamber 38 and channel 40 for flow of ink to the nozzle. For example, nozzle member 18 has formed thereon barrier wall 92*a* for nozzle 52*a* and barrier wall 92*b* for nozzle 52*b*. Likewise, barrier walls 94*a*–94*b*, 96*a*–96*b*, 98*a*–98*b* are provided for nozzles 54*a*–54*b*, 56*a*–56*b*, 58*a*–58*b*, respectively, and barrier walls 102*a*–102*b*, 104*a*–104*b*, 106*a*–106*b*, 108*a*–108*b* are provided for nozzles 62*a*–62*b*, 64*a*–64*b*, 66*a*–66*b*, 68*a*–68*b*. All "a" suffixed barrier walls are preferably substantially identical and all "b" suffixed barrier walls are preferably substantially identical. Accordingly, and for the sake of clarity, only representative ones of the barrier walls will be described, it being understood that the additional barrier walls are of like construction.

To facilitate the supplying of ink to the nozzles in a desired manner and to reduce interference from the operation of adjacent nozzles, it is preferred that the nozzles of adjacent rows of an array be spaced apart a distance R corresponding to from about 2 to about 20 heater widths, a "heater width" being from about 10 $\mu$m to about 80 $\mu$m, such that the nozzles of adjacent rows are spaced apart by a distance of from about 20 $\mu$m to about 1000 $\mu$m. In addition, for a printer having a resolution of 600 dpi, it is preferred that each nozzle be longitudinally staggered a distance S of from about 40 $\mu$m to about 400 $\mu$m relative to adjacent nozzles in the same row and latitudinally staggered a distance T of from about 42 $\mu$m to about 84 $\mu$m relative to adjacent nozzles of the other row.

Figure 5B:
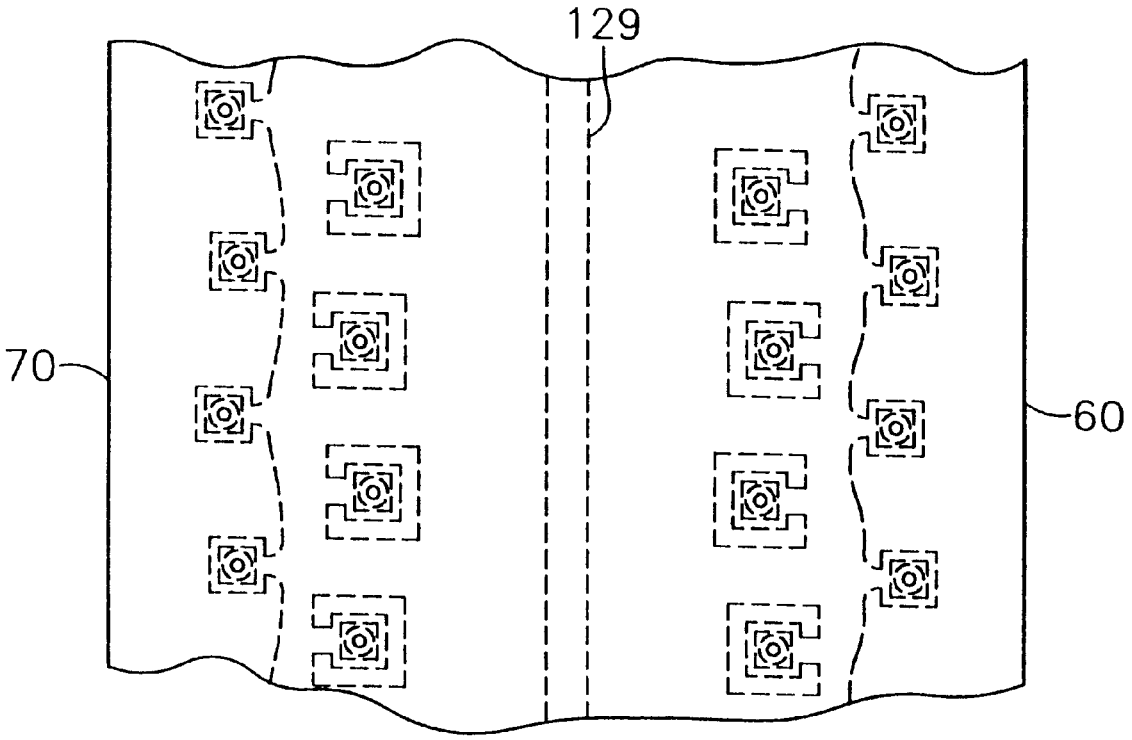
FIG. 5*b* is an enlarged partial top view of another nozzle plate according to the invention.

In addition, it is preferred that the channels or flow paths to the bubble chambers of the nozzles closest to the edges 60 and 70 of the silicon member, that is, channels 112*a*–112*b*, 114*a*–114*b*, 116*a*–116*b*, 118*a*–18*b* which supply ink to the bubble chambers of nozzles 52(*a*),(*b*)–58(*a*), (*b*), respectively, face away from the adjacent edge while channels 122*a*–122*b*, 124*a*–124*b*, 126*a*–126*b*, 128*a*–128*b* which supply ink to the bubble chambers for the nozzles farther from the edges 60 and 70, that is, nozzles 62(*a*)–(*b*), 68(*a*)–(*b*), face toward the adjacent edge. For a silicon member having a central ink via 129, the orientation of the channels for the bubble chambers for each nozzle is reversed as shown in FIG. 5*b*.

As may be appreciated, the orientation of the channels may be such as to not only provide multiple flow paths to each nozzle, the nozzle orientation also provides flow paths which are of substantially the same length. Thus, for the purpose of an example, it will be noted that flowpaths F1 and F2 are available to feed nozzle 58*b* and flowpaths F1' and F2' are available to feed nozzle 68*a*, and that the length and area of flowpath F1, F1', F2 and F2' as measured from the edge 60 of the silicon member are not appreciably different such that the path by which the ink travels to a particular nozzle does not appreciably effect filling of the chamber. In this regard, the flow path to each nozzle is preferably from about 40 $\mu$m to about 300 $\mu$m and most preferably about 85 $\mu$m, with the variance between the flowpaths ranging about ∀20%.

Without being bound by theory, and for the purpose of example, it has been observed that the following parameters associated with the positioning and sizing of the barriers and channels may effect the flow of ink to the nozzles:

| parameter | description |
|---|---|
| a | bubble chamber width |
| b | bubble chamber length |
| c | width of the smallest repeating element |
| d1 | length of the bubble chamber entry region |
| d2 | length of the bubble chamber entry region |
| e | wall thickness |
| w1 | width of the bubble chamber entry region |
| w2 | width of the bubble chamber entry region |

Preferred ranges for these parameters are as follows for a printer resolution of 600 dpi and a silicon member having a length of about 14.5 mm, a width of about 0.4 mm and having 2 arrays spaced apart about 804 $\mu$m, with 304 nozzles per array.

| Parameter | dimension ($\mu$m) |
|---|---|
| a | 42 ± 10 |
| b | 42 ± 10 |
| c | 42⅓ |
| d1 | 20 ± 10 |
| d2 | 20 ± 10 |
| e | 10 ± 5 |
| w1 | 20 ± 10 |
| w2 | 20 ± 10 |

Accordingly, a significant advantage of the invention relates to the provision of at least two nozzle/heater pairs for each print location. This enables a heretofore unavailable redundancy feature which reduces the detrimental effect of an impaired or failed heater/nozzle. For example, during operation of the printhead, a signal may be received to activate the heater for a desired print location. In the event this heater has failed or its associated nozzle is clogged or otherwise malfunctioning, there will be a lack of ink on the paper to be printed due to the problem with the heater/nozzle. However, due to the redundancy of the printhead of the invention, this lack of ink will only occur during every other print cycle for the desired location, since the corresponding heater/nozzle pair will be activated during the next activation of the instant print location. For example, nozzle/heater 52*a*/72*a* and nozzle/heater 52*b*/72*b* each correspond to the same print location, but are operated alternatively when the print location is activated such that the effect of failure of one of the pair is reduced.

Another significant advantage of the invention is that multiple flow paths to a given nozzle/heater may be provided. In this regard, it is noted that nozzle disfunction may result from clogging of the flow path rather than from a problem specific to the heater or nozzle. Thus, provision of more than one flow path, such as the described flow paths F1 and F1', reduces the likelihood of nozzle misfunction due to clogging of flowpaths.

Figure 7:
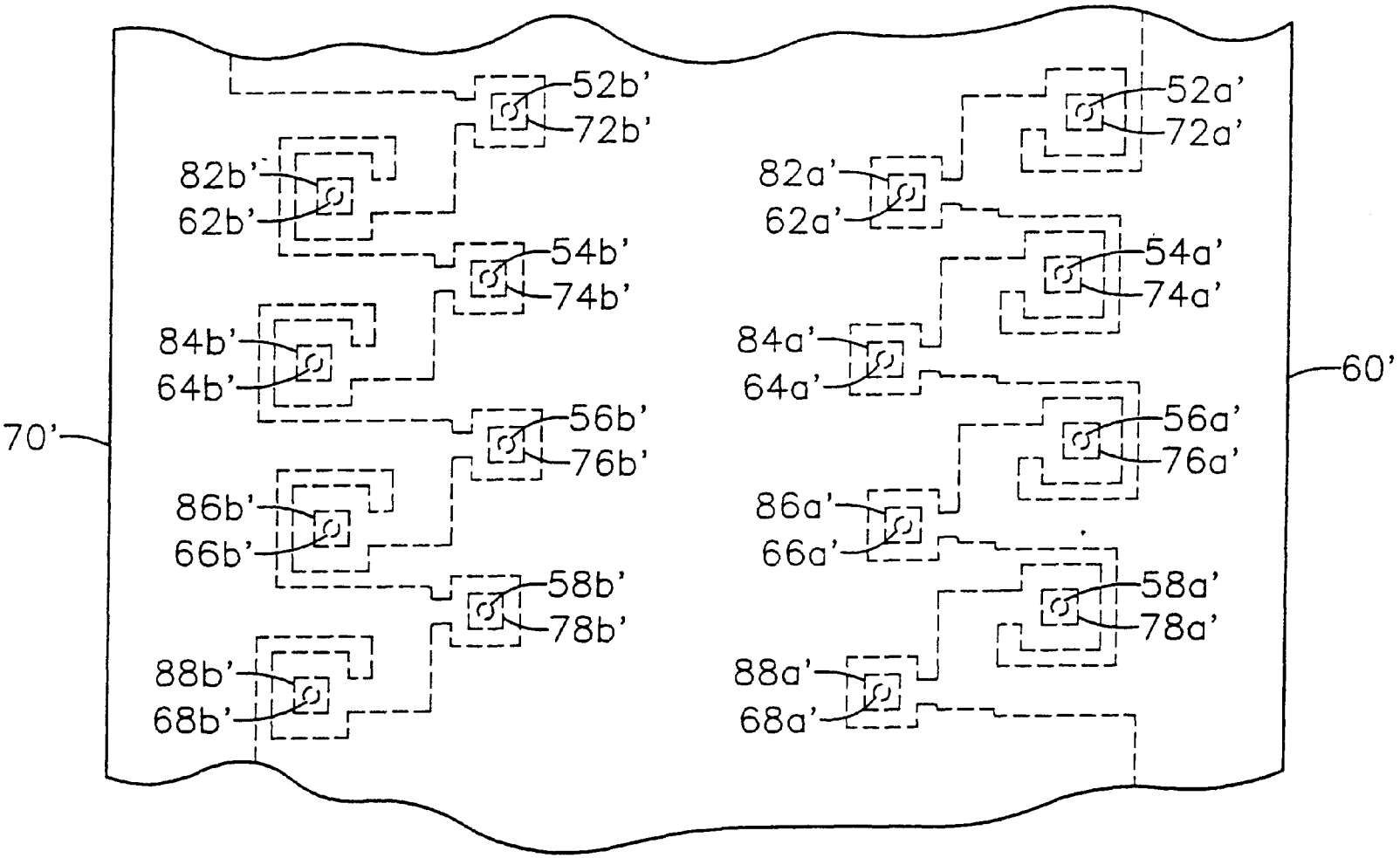
FIG. 7 is a top plan view of another nozzle plate in accordance with the invention.

With reference now to FIG. 7, there is shown another embodiment of a nozzle array in accordance with the invention. Reference numerals corresponding to the embodiment described in connection with FIGS. 5–5*b* are used to indicate the nozzles and related structure, but with a prime (') suffix. In this embodiment, a single flowpath is provided to flow ink to each nozzle pair of the arrays. For example, a single flowpath feeds nozzles 52*a'* and 62*a'*.

Figure 8:
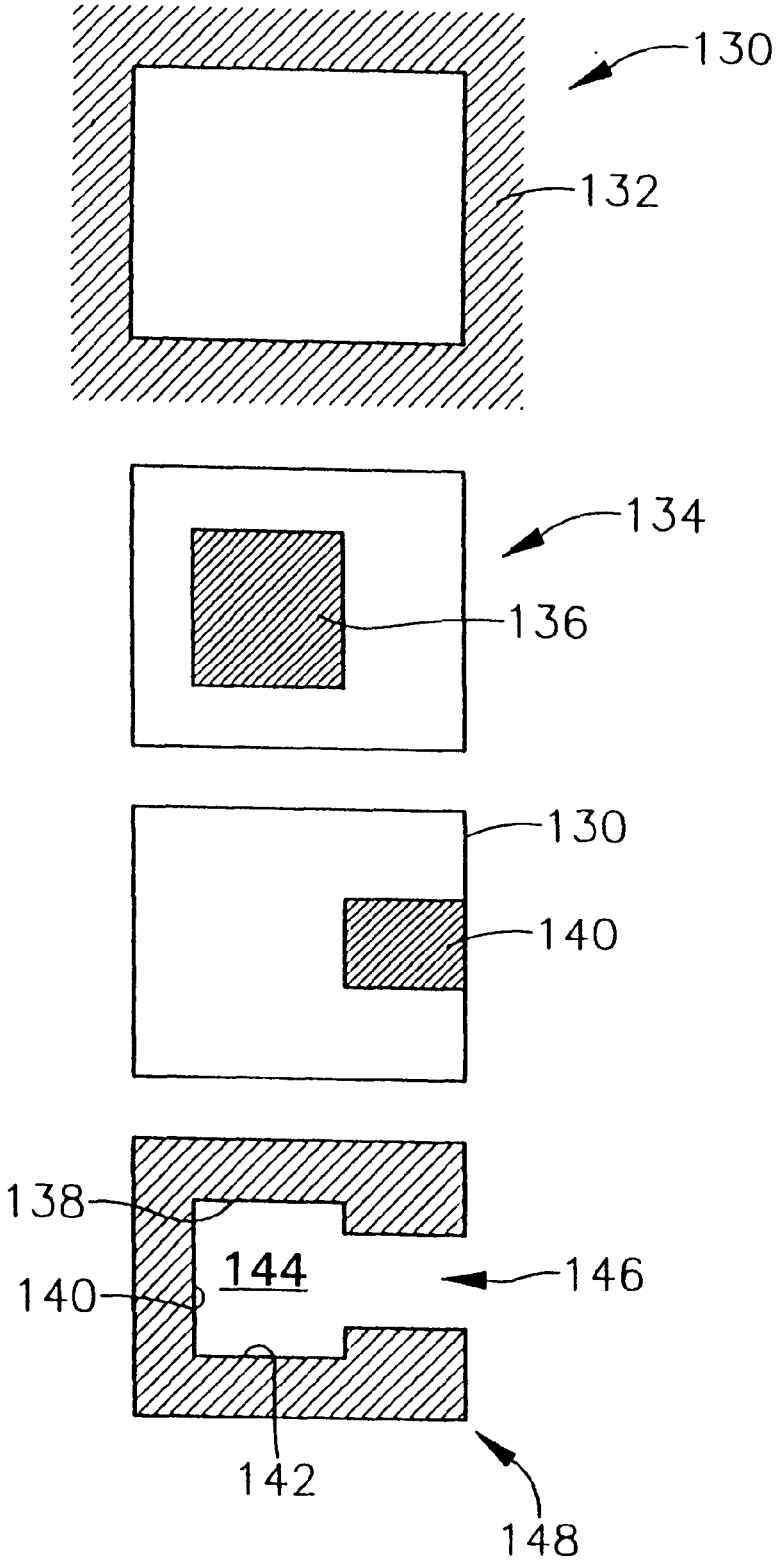
FIG. 8 provides schematic diagrams of steps in the manufacture of nozzle plates in accordance with the invention.

Turning now to FIG. 8, there is shown a preferred method for making nozzle plates and arrays in accordance with the invention. In this regard, it is initially noted that prior methods of making nozzle arrays by laser ablation are generally ill-suited for the manufacture of nozzle arrays having a structure in accordance with the invention.

For example, flow features provided in accordance with the invention include flow paths and ink chamber arrays that are much more closely spaced relative to one another than conventional ink chamber and nozzle arrays which provide only one nozzle hole for each print location. In addition, the ink chambers according to the invention have finer features, such as a substantially decreased wall thickness, as compared to conventional structures having walls of from about 10 to about 30 microns thick, generally about 10 microns thick. In contrast, ink chambers provided in accordance with the invention preferably have wall thicknesses ranging from about 2 to about 30 microns thick, generally about 4 microns thick. Conventional techniques cannot effectively provide nozzle plates having such features, as explained below in connection with FIGS. 9 and 10, which show, respectively, nozzle structures provided by the method of the invention and provided by a conventional manufacture method. The images of FIGS. 9 and 10 were digitally scanned from images of nozzle plates obtained by use of a scanning electron microscope (SEM) and show about 1% of the total nozzle plate at a magnification of about 500×.

Figure 9:
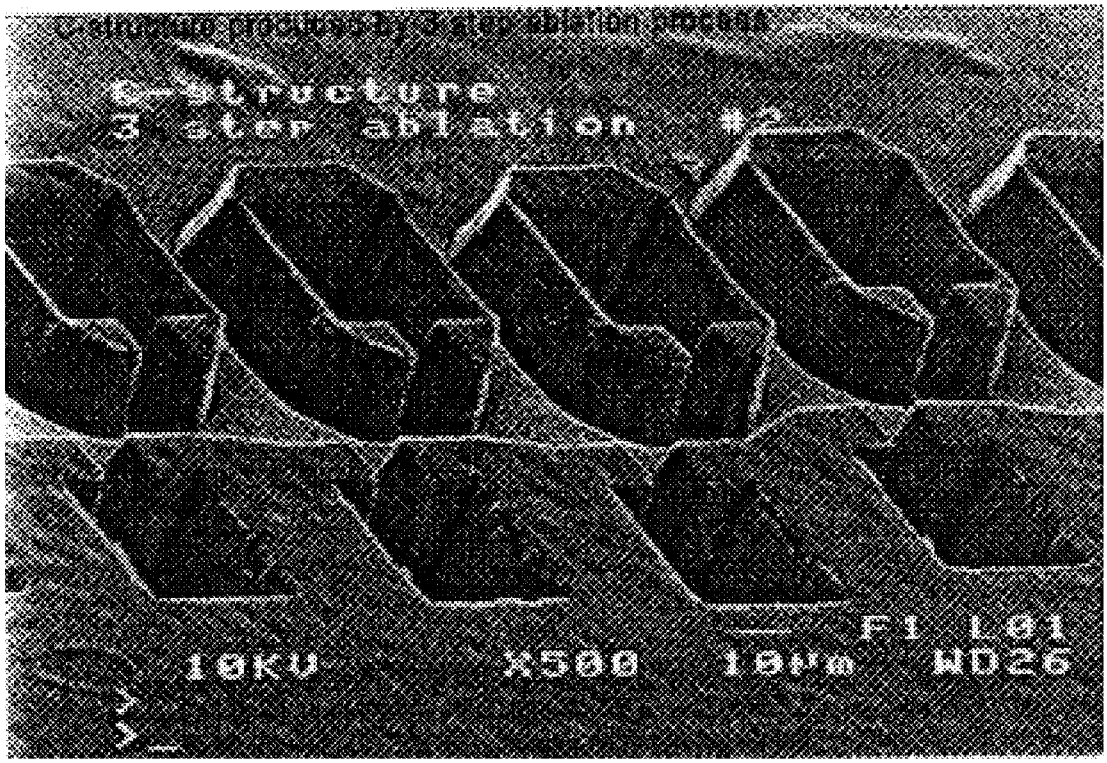
FIG. 9 is a scanned image of a nozzle plate made in accordance with the method of the invention.
Figure 10:
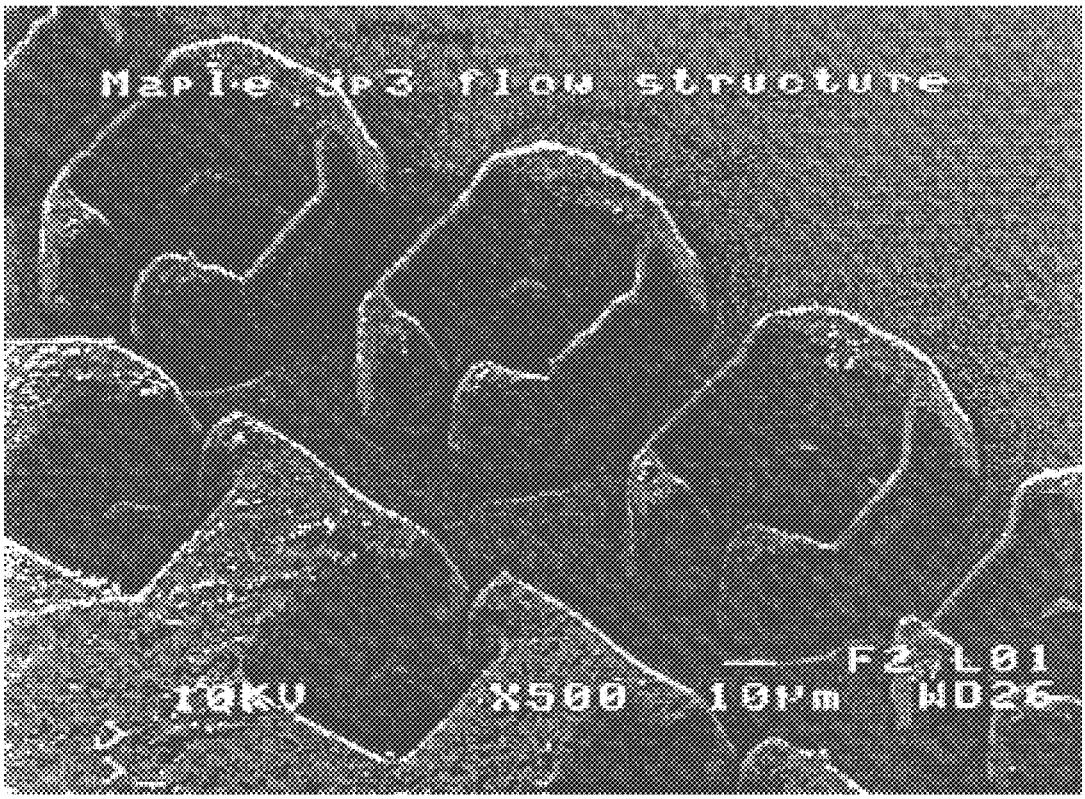
Fig. 10 Prior Art
FIG. 10 is a scanned image of a nozzle plate having a configuration in accordance with the invention but made using a conventional technique.

As will be noted, the nozzle plate of FIG. 9, which was made in accordance with the method of the invention, is more uniform in construction than the nozzle plate of FIG. 10, which includes a nozzle array structure in accordance with the invention but which was manufactured using a conventional laser ablation method.

In this regard, it is initially noted that, conventionally, laser ablation of nozzle plates is accomplished by first ablating the flow channel, ink chamber and via region, after which the nozzle openings, typically circular in shape, are ablated into the centers of the chambers. It has been experienced that this process typically results in damaged or irregular contoured chamber walls which may fail during bonding of the nozzle plate to the chip and/or otherwise fail to provide a suitable ink-tight interface at the chip/plate juncture. As will be appreciated, this results in a lower yield of usable nozzle plates, leakage of ink between the upper edges of the ink chamber walls and the chip, and otherwise unsatisfactory printer performances.

It has been further experienced that such shortcomings of conventional processes are manifested to an even greater degree when used to provide structures having finer detail, such as the nozzle plate structures of the invention. For example, with reference to FIG. 10, it will be noticed that the upper edges of the walls are of irregular shape and somewhat ragged. As will be appreciated, these surfaces are difficult to bond to the chip in a manner which provides a substantially ink-tight bond. A result of this is leakage of ink between the upper edges of the chamber walls and the chip.

In contrast, FIG. 9 shows a nozzle array of the invention provided in accordance with the preferred method of the invention. As will be noticed, the walls do not include the irregularities of the walls of the array of FIG. 10 and the upper wall edges all lie substantial in the same plane, hence a bond between the chip and the upper wall edges which is significantly more resistant to ink leakage. It will further be noticed that the walls are significantly thinner than those of the array of FIG. 10 and that the other topographical features are significantly finer in detail and more precise than features formed in a nozzle plate member by a conventional technique.

Returning now to FIG. 8, a nozzle array structure is provided in accordance with the invention by first selecting the desired locations for the nozzle holes and ablating the area 132 of the nozzle plate material or substrate 130 surrounding the future location of the holes to a predetermined depth, preferably from about 10 to about 40 microns. Next, as indicated by reference numeral 134, the nozzle holes 136 are ablated in the material, with the unremoved material surrounding each nozzle hole 136 providing sidewalls 138, 140 and 142 of a bubble or ink chamber 144. Each nozzle hole 136 preferably has a square configuration and extends the full thickness of the substrate 130. The throat regions 146 are then ablated, connecting the bubble chamber 144 with the flow path outside of the chamber 144 to provide the completed structure 148.

While specific embodiments of the invention have been described with particularity above, it will be appreciated that the invention is equally applicable to different adaptations well known in those skilled in the art.

What is claimed is:

1. A method for making a nozzle plate for an inkjet printer by laser ablating a nozzle plate material, the method comprising the steps of laser ablating the nozzle plate material to provide ink chambers, flow paths and throat regions and a first nozzle hole array containing at least two rows of nozzles having a plurality of nozzle holes in each row, each nozzle hole of the first nozzle hole array being positioned to correspond to a predetermined print location, with the print location of each of the nozzle holes of the first nozzle hole array being different from one another; and laser ablating the nozzle plate material to provide ink chambers, flow paths and throat regions and a second nozzle hole array containing at least two rows of nozzles having a plurality of nozzle holes in each row, each nozzle hole of the second nozzle hole array being positioned to correspond to a predetermined print location, with the print location of each of the nozzle holes of the second array corresponding to one of the print locations of the first nozzle hole array whereby the first and second nozzle hole arrays each have a nozzle hole corresponding to each predetermined print location so that at least two nozzle holes are provided for each predetermined print location.

2. The method of claim 1, wherein the nozzle holes are substantially square in cross section along an axis parallel to a plane defining the nozzle plate.

3. The method of claim 1, wherein the nozzle plate includes from about 20 to about 20,000 nozzle holes.

4. The method of claim 1, wherein the nozzle plate material comprises a polyamide polymer.

5. The method of claim 1, wherein the nozzle holes for each print location are in vertical alignment and horizontally spaced apart a distance of from about 20 to about 1000 $\mu$m.

6. The method of claim 1, wherein the nozzle holes are arranged in spaced apart arrays, with each array containing a nozzle hole for each print location.

7. The method of claim 1, wherein the step of laser ablating the nozzle plate material comprises the steps of a) selecting a location for each nozzle hole, b) ablating a first portion of the nozzle plate material adjacent each nozzle hole location to a predetermined depth to provide at least two flow paths for each nozzle hole c) ablating nozzle holes through the full thickness of the nozzle plate material at each nozzle hole location, wherein unablated material remains adjacent each nozzle hole to provide the ink chambers, and d) ablating the throat region through a second portion of the nozzle plate material adjacent each nozzle hole so that each ink chamber is in flow communication with at least one flow path outside of the chamber.

8. A method for making a nozzle plate for an inkjet printer by laser ablating a nozzle plate material, the method comprising the sequential steps of a) selecting a plurality of locations for nozzle holes, b) ablating a first portion of the nozzle plate material adjacent each nozzle hole location to a predetermined depth to provide a plurality of flow paths c) ablating nozzle holes through the full thickness of the nozzle plate material at each nozzle hole location, wherein unablated material remains adjacent each nozzle hole to provide an ink chamber, and d) ablating a throat region through a second portion of the nozzle plate material adjacent each nozzle hole so that each ink chamber is in flow communication with at least one flow path outside of the chamber.

9. The method of claim 8, wherein the nozzle holes are substantially square in cross-section along an axis parallel to a plane defined by the nozzle plate.

10. The method of claim 8, wherein the predetermined depth is from about 4 to about 10 microns.

11. The method of claim 8, wherein each ink chamber has a plurality of walls, each wall having a thickness of from about 4 to about 10 microns.

12. The method of claim 11, wherein each wall of each ink chamber has a free surface which is substantially flat and uniform and is suitable for providing a substantially leak-free interface between the free surface of the chamber walls and a silicon chip when the nozzle plate is attached to the silicon chip.

* * * * *